United States Patent [19]

Swift

[11] Patent Number: 4,950,007

[45] Date of Patent: Aug. 21, 1990

[54] BALL SEAL

[75] Inventor: Allan W. Swift, Denville, N.J.

[73] Assignee: E. J. Brooks Company, Newark, N.J.

[21] Appl. No.: 210,702

[22] Filed: Jun. 22, 1988

[51] Int. Cl.[5] ..... F05B 39/00

[52] U.S. Cl. ..... 292/324; 292/320

[58] Field of Search ..... 292/307 R, 324, 323, 292/325, 322, 320, 317, 318, 319

[56] References Cited

U.S. PATENT DOCUMENTS

| | | | |
|---|---|---|---|
| 1,026,943 | 5/1912 | Brooks | 292/324 |
| 1,112,123 | 9/1914 | Dow | 292/324 |
| 1,170,140 | 1/1916 | Brooks | 292/324 |
| 1,536,822 | 5/1925 | Dietze | 292/324 |
| 1,702,288 | 2/1929 | Wood | 292/324 |
| 2,343,564 | 3/1944 | Mackey | 292/324 |
| 3,980,332 | 9/1976 | King, Sr. | 292/320 |
| 4,093,287 | 6/1978 | Canter | 292/317 |
| 4,424,995 | 1/1984 | Guiler et al. | 292/323 |
| 4,690,444 | 9/1987 | Arthur | 292/324 |
| 4,733,893 | 3/1988 | Davis et al. | 292/320 |

*Primary Examiner*—Eric K. Nicholson

*Attorney, Agent, or Firm*—John G. Gilfillan, III

[57] ABSTRACT

A ball seal having an elongated, flexible metal strap for providing locking engagement with a ball-shaped housing. A locking platform, having two frangibly joined leaves, is mounted in the housing for receiving the ends of the metal strap. A pair of locking tabs are located on one leaf and a pair of locking rings are mounted on the locking platform. The seal is placed in use by passing the strap through a structure to be sealed and then sliding the ends into the locking platform to effect locking engagement between the strap ends, and the locking tabs and rings. If the strap is forced from the housing, the leaf having the locking tabs thereon will be torn from the other leaf at the frangible joint, thereby destroying the locking platform beyond reasonable repair.

5 Claims, 3 Drawing Sheets

BALL SEAL

BACKGROUND OF THE INVENTION

The present invention relates to ball seals. More particularly the invention relates to seals of the type having a ball-shaped metal housing in which the ends of a flexible metal strap may be permanently locked such that the device must be broken to be opened and thus reveal tampering.

The ball seal has found wide spread use as a reasonably reliable means for sealing the doors of railroad freight cars, trucks, and similar containers. Examples of prior art ball seals may be found in the following U.S. Pats. No. 4,424,995; No. 4,690,444; and No. 4,093,287. These patents show various modifications of the basic sealing structure. These modifications are primarily directed at improvements in two areas, viz. reducing the vulnerability of such seals to tampering and reducing manufacturing costs.

Although most prior art varieties of ball seals have been judged relatively tamper resistant and have been used extensively because of their low cost, they have not proved entirely satisfactory under all circumstances. One critical problem confronting the developers of such seals has been the problem of preventing tampering through the reconstruction or repair of previously used, discarded seal parts by unauthorized people.

More specifically, the recommended method of opening ball seals is to cut the metal strap or shackle, remove the seal from the container being sealed, and discard the broken seal. Another method of removing such seals is by pulling the metal strap or shackle from the seal housing to force the straps and other parts out of the housing. When this latter method is used, the strap and the locking structures contained in the housing are forced through the housing opening, thereby ripping the housing and causing a large gap in the housing through which the strap and locking structure pass. The first method of removal results in a cut strap and an undamaged housing. Conversely, the second method results in a damaged housing and an undamaged strap. In both cases, the locking structure remains substantially undamaged or only slightly bent and often easily repairable. As such, those concerned with the development of such structures have recognized the vulnerability of such seals to undetected tampering since an enterprising intruder could easily acquire discarded parts, reconstruct a workable seal, and then use this seal to reseal a container entered illegally.

SUMMARY OF THE INVENTION

The general purpose of this invention is to provide a ball seal that has all of the advantages of similarly employed seals but is significantly more difficult to reconstruct or repair. To attain this, the present invention provides a unique structure in which the seal parts are less susceptible to disassemble without significant destruction of the parts.

More specifically, the present seal includes a ball-shaped housing having a locking structure therein for locking the ends of the flexible strap in the housing. The locking structure includes a frangible structure which will tear apart if the strap is forced from the housing, thereby damaging the locking structure beyond reasonable repair.

The exact nature of this invention as well as other objects and advantages thereof will be readily apparent from consideration of the following specification relating to the annex drawing in which:

DETAILED DESCRIPTION OF THE PREFERRED EMBODIMENT

Figure 1:
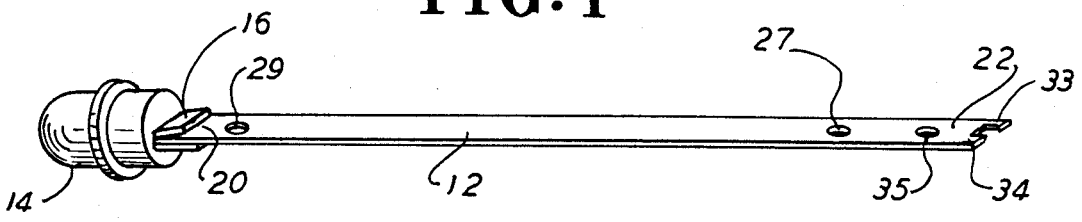
FIGS. 1 and 2 are perspective views of a preferred embodiment.
Figure 2:
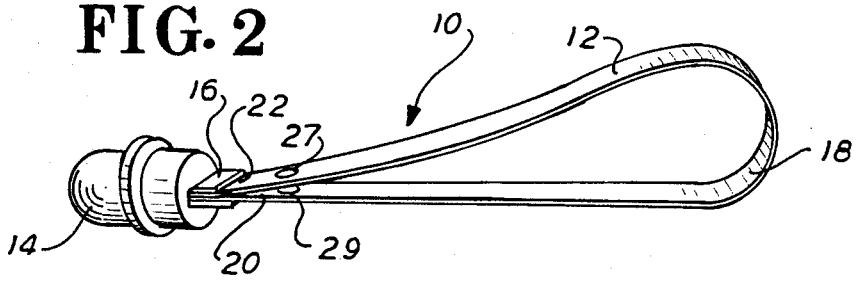

FIGS. 1 and 2, which illustrate a preferred embodiment of seal 10, show a flexible metal strap 12, a metal ball housing 14, and a metal locking platform 16. In FIG. 1 the strap 12 is shown in the ready position with end 22 free, and end 20 inserted in housing 14 and coupled to locking platform 16 in a manner to be described below. It is to be understood that although the ready position in FIG. 1 is the preferred position for storage and shipping seal 10, some users may prefer to receive their seals 10 with the strap 12 free from the housing 14. With the straps 12 unassembled, users may readily process them in metal embossing equipment to print data thereon such as codes, company names, serial numbers, and the like. Additionally, straps of various lengths may be used with the basic ball housing 14. It may be convenient for users to store a plurality of straps 12 having a number of different lengths and simply choose the proper length strap 12 for a particular application when needed. For example, in some situations a user may wish to seal a large number of closures using a long strap 12 with a single housing 14.

When seal 10 is put into use, the free end 22 is first threaded through an appropriate structure to be sealed (not shown), the strap 12 is then bent to form loop 18, and the end 22 is inserted into the locking platform 16. In this position, called the locked position, the strap 12 functions as a shackle. With the seal 10 in the locked position, either the strap 12 must be cut or the housing 14 and locking platform 16 destroyed to remove the seal from the structure being sealed. Also, as will be explained below in detail, locking platform 16 is designed to be permanently destroyed, along with the housing 14, when the seal 10 is opened by forcing the strap 12 from the housing 14.

Figure 3:
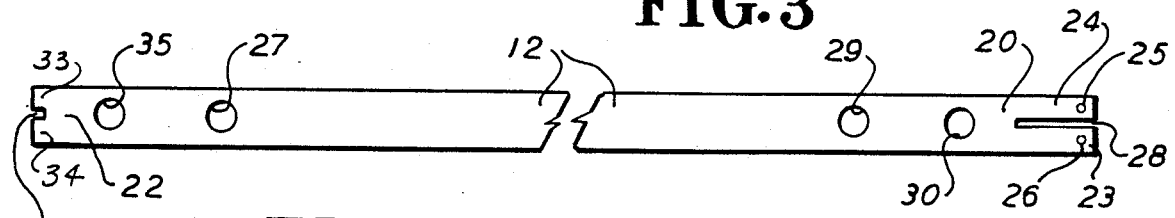
FIG. 3 is a plan view of a portion of the preferred embodiment.
Figure 3A:
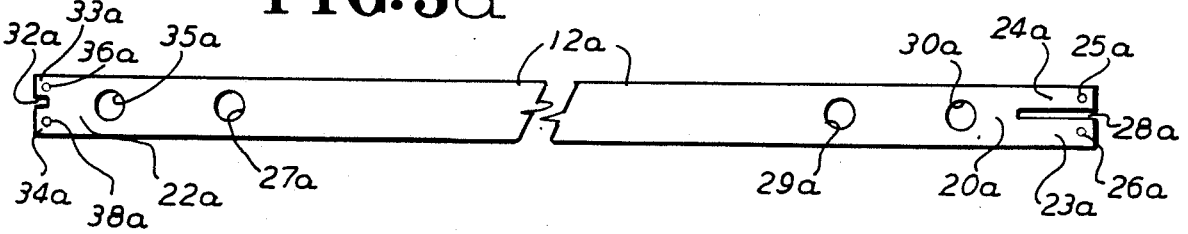
FIG. 3*a* is a plan view of a portion of a different embodiment.

FIGS. 3 and 3*a* show plan views of different embodiments of the strap, one embodiment being designated 12 and the other embodiment designated 12*a*. Strap 12 has ends 20. 22. End 20 includes a central slot 28, forming spaced fingers 23. 24 each having a hole 25. 26 formed therein. A third hole 30, formed in end 20, is longitudinally spaced from slot 28. The other end 22 includes a central slot 32, forming fingers 33. 34 and a longitudinally spaced hole 35 of a size equal to hole 30. Alignment holes 27 and 29 are formed in ends 22 and 20, respectively. When the seal 10 is put into the locked position, as shown in FIG. 2, the user can be assured that the ends 20 and 22 are properly aligned within the housing 14 by viewing the alignment of holes 27 and 29. A seal 10 that cannot be fixed with the holes 27 and 29 aligned should be investiated for tampering, improper assembly, etc.

FIG. 3*a* shows a modified strap 12*a*, having a number of parts similar to those on strap 12 in FIG. 3. Like reference characters in FIGS. 3 and 3*a* correspond to similar parts. Strap 12*a* includes ends 20*a*, 22*a*; holes 25*a*, 26*a*, 27*a*, 29*a*, 30*a*, 35*a*; central slots 28*a*, 32*a*; and fingers 23*a*, 24*a*, 33*a*, 34*a* corresponding to similar parts on strap 12. Holes 36*a*, 38*a*, formed in fingers 33*a*, 34*a*, respectively, are of a size and spacing equal to that of holes 25*a*, 26*a* on fingers 23*a*, 24*a*, for a purpose to be later described.

Figure 4:
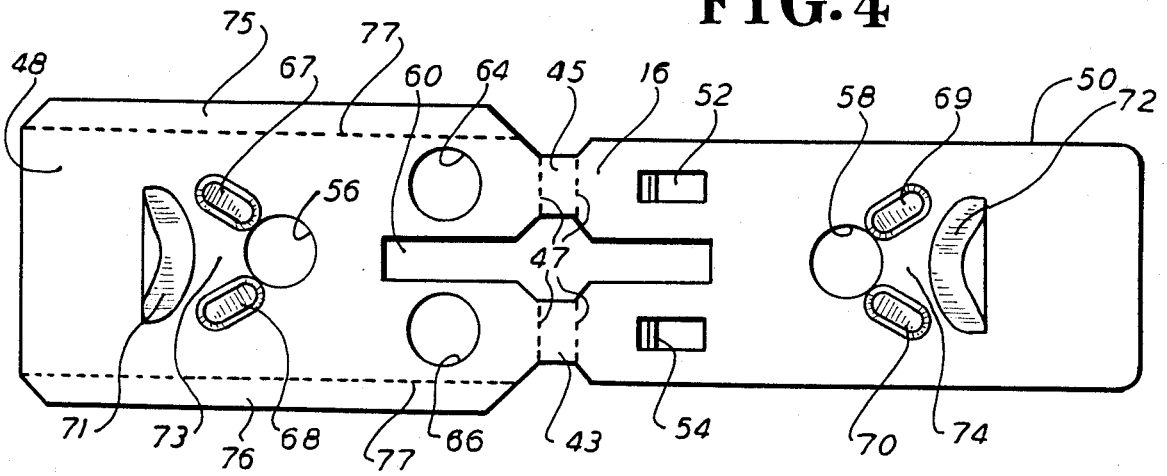
FIG. 4 is an enlarged plan view of a portion of the preferred embodiment.

Platform 16 is preferably stamped from a piece of resilient sheet metal. FIG. 4 shows a plan view of platform 16 after being cut but prior to being bent into its final shape. Platform 16 includes a first leaf 48 and a second leaf 50 joined by narrow frangible joints 43, 45. An elongated slot 60 extends through a portion of leaves 48. 50 and between frangible joints 43. 45. Joints 43, 45 are described as frangible because they are made substantially weaker than the other parts of platform 16. Joints 43. 45 may be made selectively narrower and therefore selectively weaker. Also, one or more of the fold lines 47 may be scored to make the joints 43, 45 as frangible as desired within the elastic limit of the metal of which platform 16 is fabricated.

Spaced from the ends of slot 60 and located generally near the center of leaves 48, 50, are identical ring holes 56, 58, respectively. Cut from leaf 50, on opposite sides of slot 60, are a pair of lock tabs 52. 54. Lock tabs 52, 54 are cut from and bent out of the plane of leaf 50. Tabs 52, 54 are resilient and act as leaf springs. Tabs 52, 54 can be bent back toward the plane of leaf 50 with considerably less force than required to bend the tabs 52, 54 further away from the plane of leaf 50, for a purpose that will become evident later.

On opposite sides of slot 60 on leaf 48 are a pair of tab holes 64, 66. Embossed ribs 67. 68, and 69, 70 are located adjacent holes 56. 58, respectively, in a generally V-shaped arrangement. A pair of embossed pull-out stops 71, 72 are located on leaves 48. 50 between the free ends thereof and the ribs 67, 68, and 69, 70, respectively. Generally triangular flat areas 73. 74 are formed on leaves 48, 50 between the embossed ribs 67. 68 and 69, 70, and the embossed stops 71. 72. The flat areas 73, 74 extend to holes 56. 58 for a purpose to be later described. A pair of side tabs 75. 76 extend from leaf 48 and are defined by dashed fold lines 77 in FIG. 4.

In its final form, the platform 16 is folded along fold lines 47. 77 to form a pair of generally parallel, superimposed leaves 48, 50 joined by perpendicular joints 43 45. Tabs 75, 76 are bent into a plane perpendicular to the plane of leaf 48 and extend toward leaf 50 to form a generally enclosed volume having an entrance opening formed by the free ends of leaves 48, 50. Tabs 52, 54 extend toward holes 64, 66, respectively. Holes 56. 58 are superimposed on each other as are areas 73, 74. The embossed ribs 67–70 and embossed stops 71. 72 are raised on the outside surfaces of platform 16.

Figure 5:
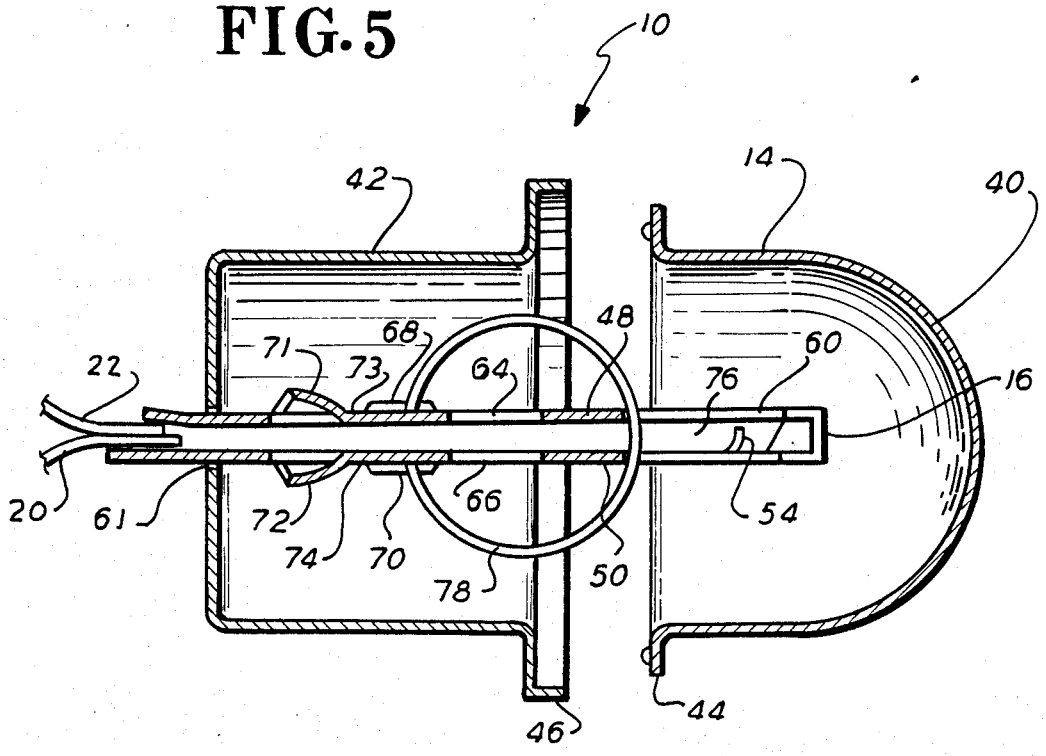
FIGS. 5 is a sectional view of the preferred embodiment taken on the line 5—5 of FIG. 10, looking in the direction of the arrows.
Figure 10:
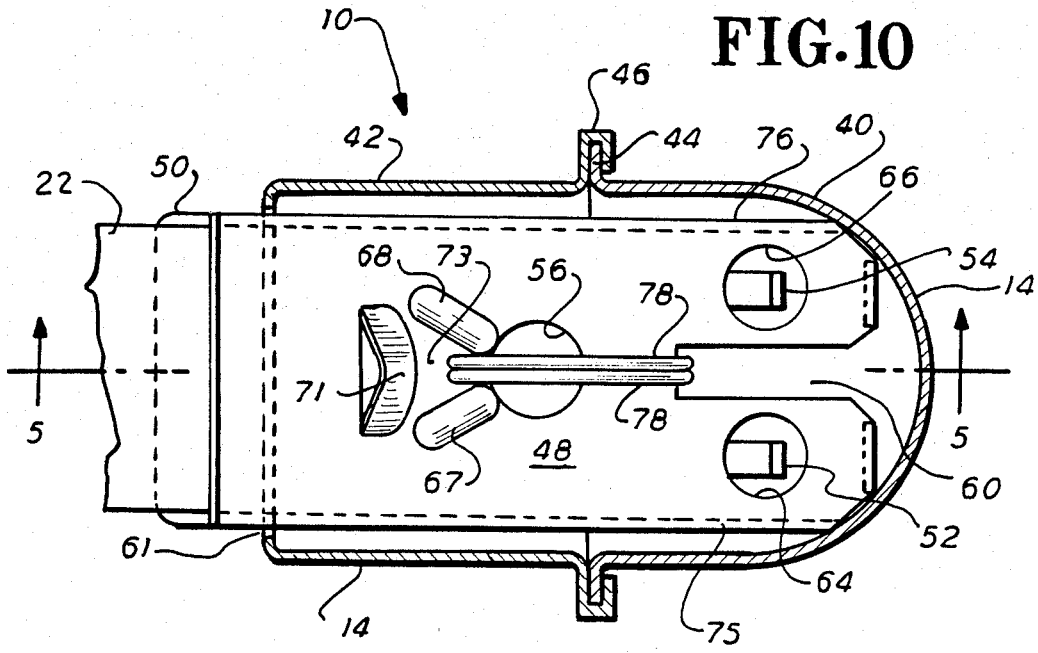
FIG. 10 is a plan view, partly in section, of the device shown in FIG. 5.

Ball housing 14, also cut from sheet metal, consist of two cup-shaped elements, a slotted half 42 and a closed half 40. The cross-sectional shape of halves 40. 42 is generally circular when looking in a vertical plane perpendicular to the plane of FIG. 5. Housing 14 includes circular flanges 44, 46 on halves 40, 42, respectively.

In assembling the seal 10, a pair of split locking rings or springs 78 are first mounted on folded platform 16. Rings 78 pass through slot 60 and straddle platform 16. The ends of rings 78 are forced apart and made to rest on the areas 73, 74 on opposed outside surfaces of platform 16. After having rings 78 mounted thereo, platform 16 is placed inside the halves 40, 42 with the free ends protruding through slot 61. The halves 40, 42 are then joined together at the flanges 44, 46. Flanges 44, 46 are preferably welded together before folding flange 46 over flange 44. As a last step, the welded flanges 44, 46 may be compressed together by rolling. The flanges 44, 46 are preferably joined in this fashion to prevent tampering. With the flanges 44, 46 welded together, significant damage to housing 14 will be required to open the housing 14 at that location.

Figure 6:
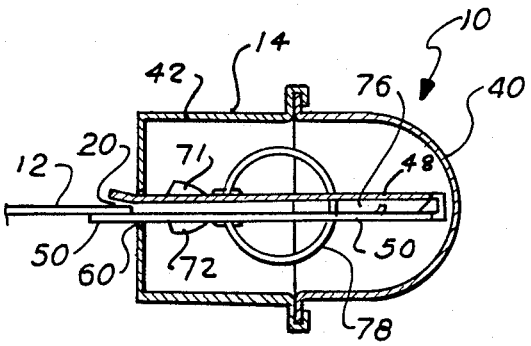
FIGS. 6–9 are side elevation views, partly in section, of the devices shown in FIGS. 11–14, respectively.
Figure 11:
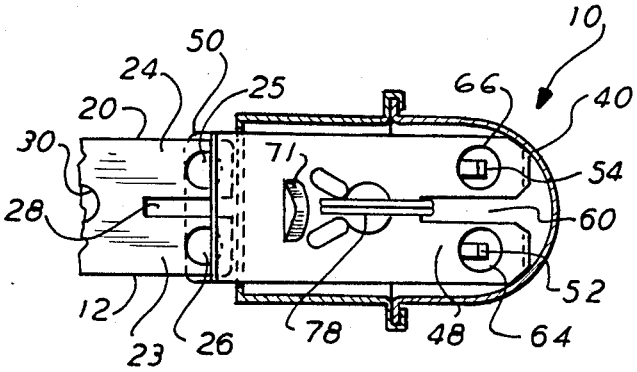
FIGS. 11–14 are plan views, partly in section, of the devices shown in FIGS. 6–9, respectively.
Figure 7:
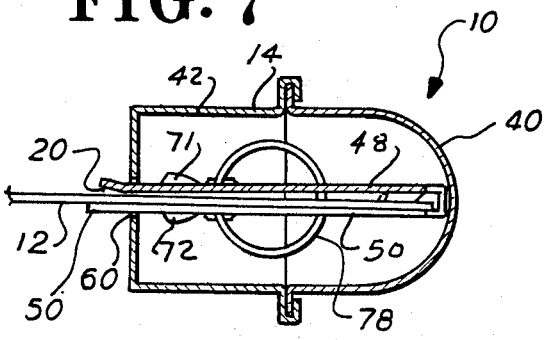
Figure 12:
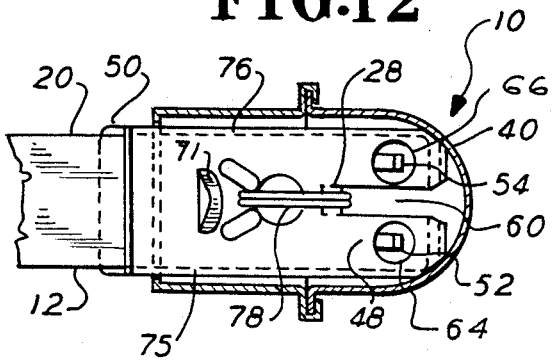

FIGS. 6–9 and 11–14 show seal 10 at various stages of insertion of strap 12 in locking platform 16. As mentioned earlier, the seal parts could be delivered to a user with strap 12 or 12A either connected or disconnected to the platform 16 in housing 14. In either case the seal 10 is put into the ready position (FIG. 1) by inserting end 20 between the free ends of platform 16 as shown in FIGS. 6 and 11. The tabs 75. 76 (tab 76 has been cut away in FIGS. 6–9) will guide the end 20 as it moves toward the lock tabs 52. 54. The slot 28 is of a length equal to or greater than the effective length of slot 60 as shown in FIGS. 11, 12. As the end 20 moves into the platform 16, the fingers 23. 24 pass on either side of rings 78 and eventually encounter tabs 52, 54. As end 20 is forced further along platform 16, the tabs 52, 54 are deflected by fingers 23. 24 and remain deflected until holes 25. 26 come into juxtaposition therewith. The tabs 52, 54 are then free to spring back into their unstressed position and into locking engagement with holes 25. 26 as shown in FIGS. 7 and 12. At this point the seal 10 is in the ready position (FIG. 1).

Figure 8:
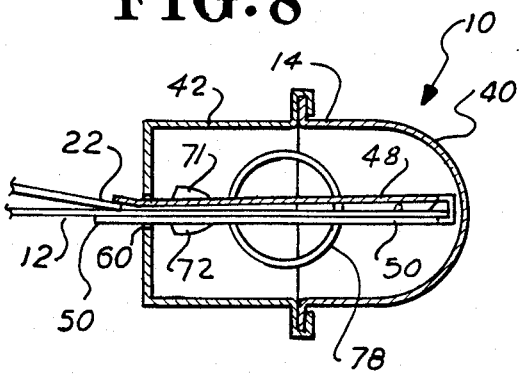
Figure 13:
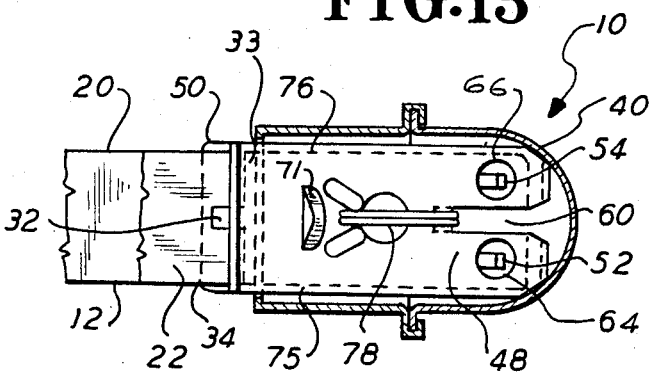

When seal 10 is put into use, the end 22 is inserted into platform 16 in much the same way that end 20 was inserted (FIGS. 8, 13). However, prior to insertion, the end 20 is threaded through an appropriate structure on a container to be sealed (not shown) in a manner well known to those skilled in these arts.

Figure 9:
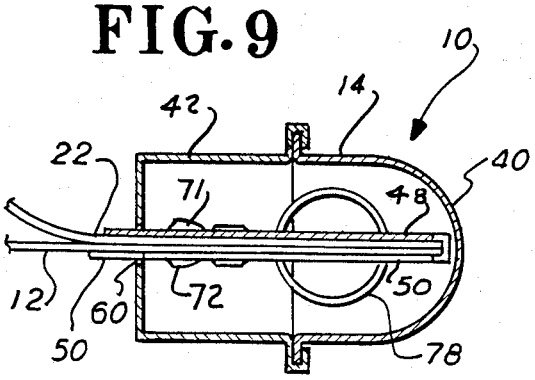
Figure 14:
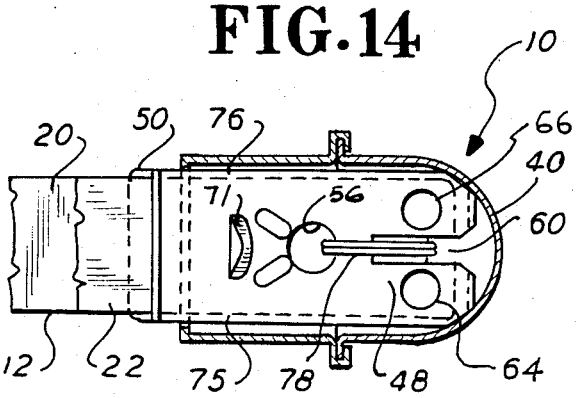

After insertion, the fingers 33, 34 will be positioned on either side of springs 78, which are presently contained in slot 32. The strip 12 will now push springs 78 and force the ends thereof along the areas 73. 74 and into the holes 30, 35, 56, 58 all of which are axially aligned as shown in FIGS. 9 and 14. The embossed ribs 67, 68, 69, 70 guide the ends of springs 78 into the holes 56, 58, 30, 35 during this process.

With the strap 12 in the locked position (FIG. 2), it will be necessary to break the seal to remove it from the container being sealed (not shown). As explained earlier, the usual method of removal is to simply cut the strap 12. However, an intruder wanting to illegally open the seal without cutting the strap 12 might pull on the strap 12 in an attempt to force it from the housing 14 in the area of slot 61. When such action is taken, the end 20 will pull on the tabs 52, 54, forcing the embossed pullout stops 71, 72 against the slotted wall on half 42. If sufficient additional force is used on strap 12, the leaf 50, containing tabs 52, 54, will begin to force pullout stop 72 still further against the slotted wall on half 42 until there is an eventual rupture of housing 14. In the meantime, the leaves 48. 50 will move with respect to each other and frangible joints 43, 45 will begin to bend and subsequently break, thereby separating the leaves 48, 50 and disengaging the rings 78 from the locked position (FIGS. 9. 14). Finally, the leaf 50 will be pulled from the ruptured housing 14. As such, although the intruder will now have a useable strap, he will have a significantly damaged housing 14 and platform 16.

Various modifications are contemplated and may obviously be resorted to by those skilled in the art. For example, there are two embodiments of straps 12. 12*a*. The strap 12*a* shown in FIG. 3*a*, has an end 20*a* that includes holes 25*a*, 26*a*, 36*a*, 38*a*, for effecting locking engagement with the tabs 52, 54. Therefore, if an intruder should pull on end 20*a* by itself, or end 22*a* by itself, or both ends 20*a* and 22*a* together, the platform 16 can in each case be forced from the housing 16. It is noted that considerable force will be needed to accomplish this. In contrast, the strap 12 in FIG. 3 has holes for engaging tabs 52. 54 on only one end thereof viz. holes 24, 26 on end 20. Therefore, if an intruder should pull only on end 22, the platform 16 will not be affected except that rings 78 will be disengaged, thereby preventing reuse of the seal 10 by reinserting end 22. The force necessary to pull end 22 from a locked seal 10 is considerably less than that required to pull end 22*a* from a locked seal 10. In either embodiment, however, it will always be necessary to pull the leaf 50 of platform 16 from a ruptured housing 14 to remove the entire strap 12 or 12*a* from housing 14.

Obviously other modifications and variations of the present invention are possible in the light of the above teachings. It is therefore to be understood that, within the scope of the appended claims, the invention may be practiced otherwise than as specifically described.

What is claimed is:

1. A ball seal comprising:

an elongated flexible strap having first and second ends;

a housing having an entrance opening therein;

a strap lock disposed in said housing;

said strap lock including a locking means for engaging said first end of said strap upon insertion of said first end in said entrance opening and for preventing removal of said first end from said entrance opening;

said strap lock having a frangible means for causing said strap lock to fracture upon the application of a predetermined force on said first end;

said strap lock includes a pair of spaced, superimposed leaves joined to each other at one end by said frangible means; and said locking means includes at least one resilient tab extending from one of said leaves and said first end of said strap includes a hole for engaging said tab.

2. A ball seal according to claim 1 wherein said second end of said strap includes a hole for engaging said tab when said second end is inserted in said housing.

3. A ball seal according to claim 1 further comprising:

at least one split resilient ring having ends straddling said leaves in a stressed condition;

said leaves having superimposed holes therein:

said first end of said strap having a hole superimposed with the holes of said leaves when said first end is engaging said tab: and said second end of said strap having a hole therein and including a means for moving said ends of said ring into engagement with the superimposed holes in said leaves and said first end, and the hole in said second end.

4. A ball seal comprising:

an elongated flexible strap having first and second ends:

said first end having first and second longitudinally spaced holes:

said second end having a hole therein:

a locking platform having first and second superimposed leaves connected by a frangible joint at one end thereof and having aligned holes therein:

said first leaf having at least one resilient tab extending therefrom toward said second sheet and located between said aligned holes and said joint:

a resilient spring having an unstressed shape forming a loop with first and second ends;

said spring being mounted on said platform with said first and second ends of said spring resting on opposite sides of said platform between said aligned holes and the end opposite said joint;

a housing substantially enclosing said platform and having an opening therein with a portion of said platform extending therethrough;

said first and second longitudinally spaced holes being spaced a distance equal to the distance between said tab and said aligned holes:

said first end of said strap being shaped to simultaneously permit said first hole to engage said tab and said second hole to align with said aligned holes while said strap extends through said opening in said housing and between said leaves: and said second end of said strap having means for causing said spring to pass through said aligned holes, said second hole, and said hole on said first end of said strap.

5. A seal according to claim 4 wherein:

said second end of said strap includes a second hole therein; and said holes on said first end of said strap are spaced a distance equal to the distance between said tab and said aligned holes.

* * * * *